US005172915A

United States Patent [19]

Flis

[11] Patent Number: 5,172,915

[45] Date of Patent: Dec. 22, 1992

[54] PRACTICE PUTTING KIT AND METHOD

[76] Inventor: Albert J. Flis, 11427 Blodgette Creek Trail, Strongsville, Ohio 44136

[21] Appl. No.: 822,901

[22] Filed: Jan. 21, 1992

[51] Int. Cl.[5] ..... A63B 69/36

[52] U.S. Cl. ..... 273/193 R; 273/77 A; 273/167 A; 273/167 C; 273/169; 273/192; 273/174

[58] Field of Search ..... 273/77 A, 167 A, 167 C, 273/169, 192, 193 R, 193 A, 193 B, 194 R, 194 A, 194 B, 183 D, 186 A, 174; 434/252

[56] References Cited

U.S. PATENT DOCUMENTS 3,319,964 5/1967 Steinberg ..... 273/192 X
3,844,569 10/1974 Swanson ..... 273/192
4,688,799 8/1987 Johnson ..... 273/192 X

*Primary Examiner*—George J. Marlo

*Attorney, Agent, or Firm*—Fay, Sharpe, Beall, Fagan, Minnich & McKee

[57] ABSTRACT

A kit and method for practicing a gold putting stroke on a putting surface utilizing a practice putter. The practice putter comprises a handle, a shaft connected to the handle, a hosel connected to the shaft, and a head connected to the hosel. The head further comprises a body, a cavity formed in the body and extending horizontally therethrough, an axle having a middle portion supported in the cavity and two end portions extending beyond the cavity and the body, and two wheels attached to each respective end portion of the axle. Also utilized in this kit and method is a playing putter whose dimensions and weight are substantially identical to those of the practice putter. A user can efficiently improve his putting skills by utilizing the practice putter to practice putting strokes and thereafter use the playing putter to compete in regulation play.

6 Claims, 3 Drawing Sheets 18
16
10
14
20
26
21
24
23 (22)
19
$\alpha_1$
2
2
23
24
28
12
27
20
22
29
$\gamma_1$

PRACTICE PUTTING KIT AND METHOD

BACKGROUND OF THE INVENTION

This invention relates to a practice golf putting kit and method. More particularly, it relates to a practice putting system utilizing a practice putter whose head includes an integral axle and double wheel arrangement and a playing putter whose dimensions and weight substantially replicate those of the practice putter.

While the invention is particularly directed to the art of practice putting apparatuses and methods, and will be thus described with specific reference thereto, it will be appreciated that the invention may have usefulness in other fields and applications.

It is well known that although putting strokes comprise a major portion of a golfer's score, putting is not afforded a correspondingly major portion of practice time. To aid in improving a golfer's putting skills, numerous inventors have developed various training devices for putting. For instance, U.S. Pat. No. 3,319,964 to Steinberg discloses a single practice golf club utilizing an elongated wheel attachment that can be pivotally attached to the blade of a golf putter when a user desires to practice putting strokes. The wheel attachment can be removed from the golf putter when one desires to use the putter in regulation play. Steinberg does not disclose the use of two separate putters, i.e., one putter for practice and one substantially identical putter for regulation play. The disadvantage of using only the single club of the Steinberg patent, adapted for practice and play, is that the club has radically different dimensions and weight when the wheel attachment is attached to the club. It is not conducive to efficient training when the club with which one practices has a substantially different look and feel than the club used in regulation play.

Further, U.S. Pat. No. 4,535,992 to Slagle discloses a golf training device having a reel assembly including one or more reel members comprising a plurality of axially spaced, annular disk like elements which maximize the tracking action of a putting stroke. Slagle does not contemplate the use of two putters. Nor does Slagle disclose the use of only two wheels connected to one another through an axle whereby the wheels are disposed outside the body of the head of the putter.

Last, U.S. Pat. No. 4,756,535 to Bradley discloses a golf putter including a relatively thin wheel-like member mounted on a horizontal axis in the center of the head of the club. The single wheel like member can be fixed for regulation play or rotatable for use in training although Bradley contemplates the use of two clubs, it does not contemplate the use of two wheel-like members.

These prior patents do not contemplate the use of a two putter practice, or training, kit including a first putter comprising an integral axis and double wheel arrangement with the two wheels disposed outside the head of the putter, used for practice and a second putter, comprising substantially identical dimensions and weight of the first putter, used for regulation play.

SUMMARY OF THE INVENTION

A main object of the present invention is to provide an effective golf putting training kit and method.

A further object of the present invention is to provide a practice putter including two knurled wheels and a connecting axle wherein the two knurled wheels are disposed laterally outside the head of the practice putter.

A still further object of the present invention is to provide a regulation playing putter that is substantially identical to the practice putter in weight and dimension so that both putters have the same "look and feel".

A still further object of the present invention is to provide a practice putter that will assist the user in maintaining the head of the putter close to or touching the ground for the duration of a whole putting stroke, even after striking a golf ball.

A still further object of the present invention is to provide a practice putter that will assist the user in preventing angular rotation of the head of the putter relative to the desired direction of the ball during the putting stroke.

A still further object of the present invention is to provide a golf putting practice kit and method that will assist the user in contacting a golf ball at the so-called "sweet spot" of the putter head.

The above objects are achieved with a golf putting kit utilizing two putters, a practice putter and a playing putter. The practice putter is similar to a conventional putter except that the head comprises a body, a cavity formed in the body and extending horizontally therethrough, an axle substantially supported in the cavity, and knurled wheels attached to each end of the axle. The wheels are accordingly disposed outside the confines of the head of the putter. A playing putter is provided that does not include the wheel and axle arrangement of the practice putter. It is adapted for regulation play and has the same dimensions and weight of the practice putter and has no moving parts.

To be most effective, the knurled wheels of the practice putter should be engaged to the putting surface and a sufficient lateral force should be exerted on the practice putter to initiate a putting stroke. Maintaining the engagement of the wheels to the putting surface helps develop fundamental putting skills. Among these skills is the trailing of the putter head close to or even touching the putting surface for the duration of the whole stroke, even after contact with the ball. By keeping the wheels engaged to the putting surface and rolling, the user can gain the feel of keeping the head low and properly completing the stroke, or "following through".

Since the practice putter of the present invention includes an axle and two corresponding connected knurled wheels, the chances of undue angular rotation of the putter head relative to the line of the desired direction of the ball are greatly reduced, if not completely eliminated. In particular, each wheel is connected to the same axle. Thus, when the wheels rotate, they rotate in the same degree and at the same angular velocity. So long as the wheels are engaged to the putting surface and rotating, no angular rotation of the putter head will occur.

Once a user practices a putting stroke with the practice putter a plurality of times on a carpet at home or on a practice putting green, he/she will become comfortable with a fundamentally sound stroke that is low to the ground and without angular rotation of the putter head. The user can then utilize the substantially identical playing putter in regulation play.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention consists in the construction, arrangement, and combination, of the various parts of the device, whereby the objects contemplated are obtained as hereinafter and more fully set forth, specifically pointed out in the claims, and illustrated in the accompanying drawings in which:

DETAILED DESCRIPTION OF THE PREFERRED EMBODIMENTS

Figures 1, 2:
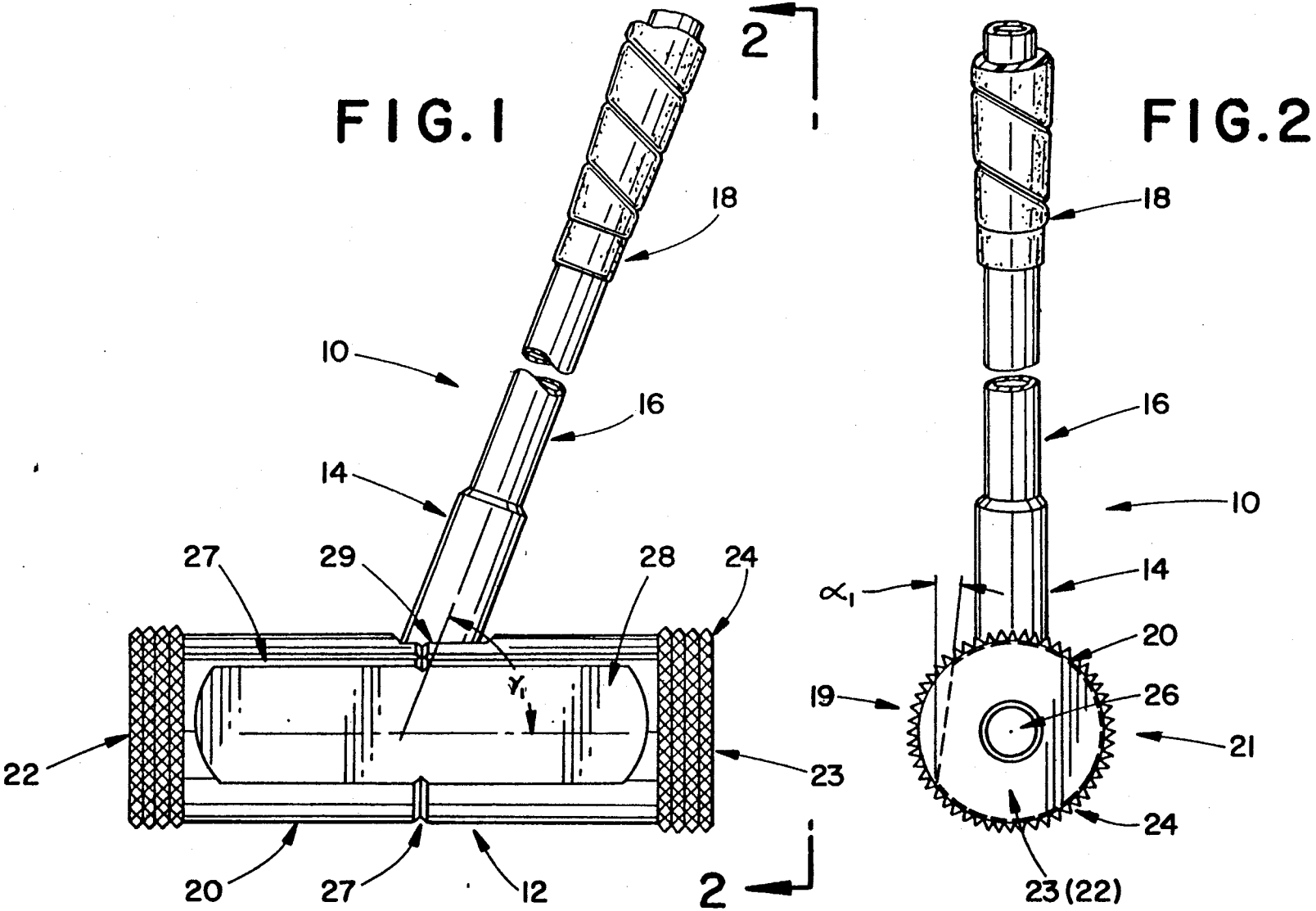
FIG. 1 is a front elevational view of the practice putter of the preferred embodiment.
FIG. 2 is a partial side elevational view of the practice putter of FIG. 1 looking in the direction of the line 2—2 of FIG. 1.

Referring now to the drawings wherein the showings are for purposes of illustrating the preferred embodiments of the invention only and not for purposes of limiting same, FIG. 1 provides a view of the practice putter 10 of the preferred embodiment. As shown, the practice putter 10 of the preferred embodiment of the present invention comprises a practice head 12, a hosel 14 interconnecting the head 12 to a shaft 16, and a handle 18. By moving handle 18, the practice head 12 may be manipulated by the way of shaft 16 and hosel 14. The head 12 further comprises a body 20 having a front portion 19 and a back portion 21 (shown in FIG. 2), first and second wheels 22 and 23, a relatively flat hitting surface 28, and a bored hole 29.

Figure 6:
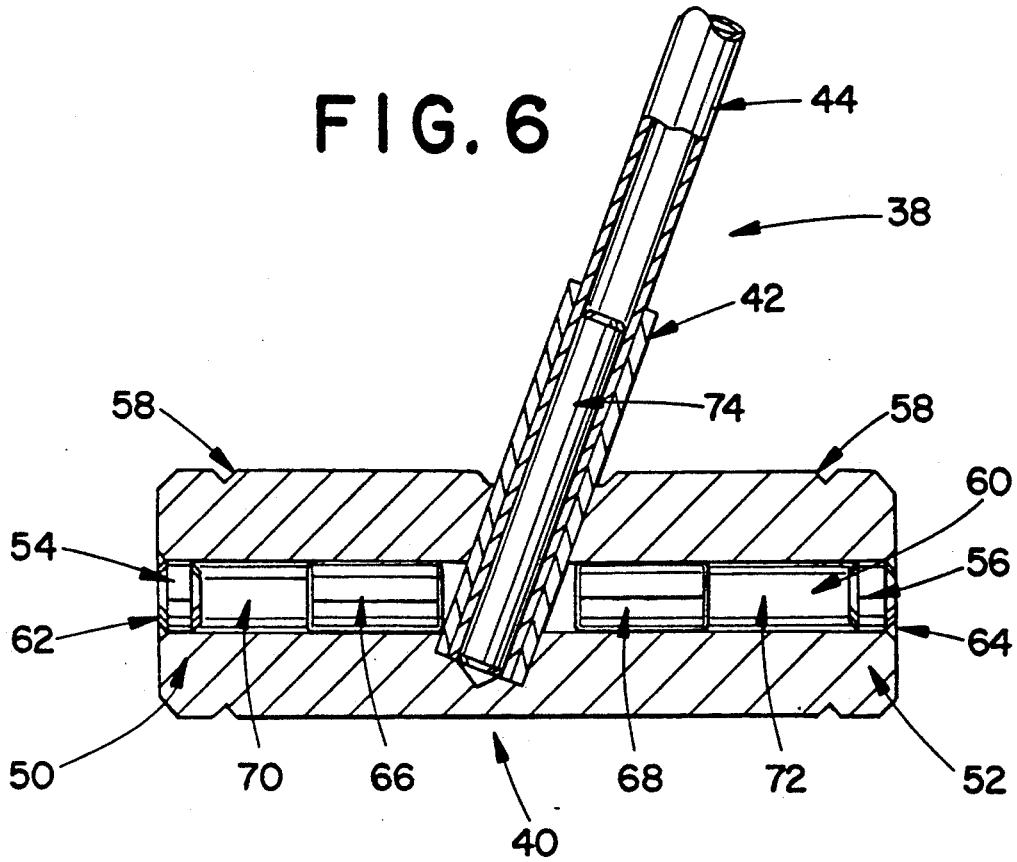
Figure 5:
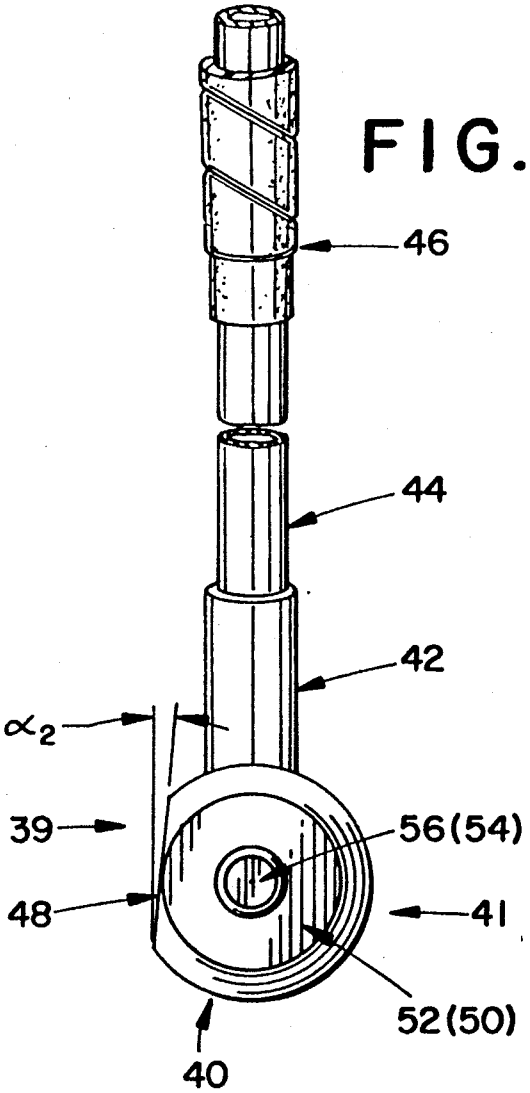
FIG. 5 is a partial side elevational view of the playing putter of FIG. 4 looking in the direction of line 5—5 of FIG. 4; and, FIG. 6 is a partial cross sectional view of the playing putter of FIG. 4.
Figure 4:
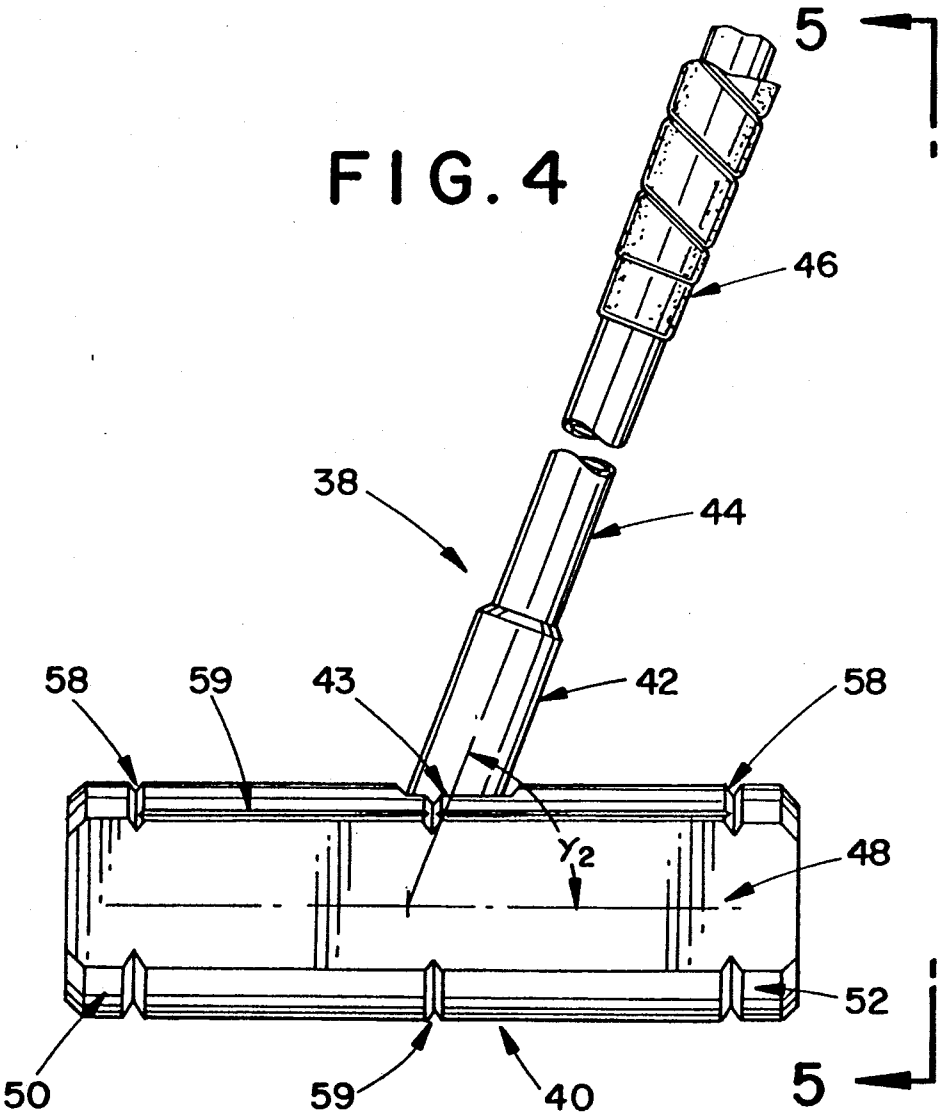
FIG. 4 is a front elevational view of the playing putter of the preferred embodiment.

It is recognized by the inventor that the construction and design of the handle 18, the shaft 16, and the hosel 14 (and their respective counterparts used in the playing putter 38, more particularly described with specific reference to FIGS. 4–6) can be of any type currently known in the industry. Therefore, specific reference to these elements will only be made as is required to particularly describe the present invention.

Furthermore, as it is well known in the art, the length and weight of the handle 18, the shaft 16, and the hosel 14 of the practice putter 10, (and their respective counterparts used in the playing putter 38) can vary depending upon the physical characteristics of the user and/or the properties desired. The present invention encompasses such differences with the limitation that these differences must be substantially the same in both the practice putter 10 and the playing putter 38.

As shown in FIG. 1, the hosel 14 is connected to the body 20 to create a lie angle $\gamma_1$ of approximately 71° in the preferred embodiment. As shown, the lie angle $\gamma_1$ is the angle between the longitudinal axis of the shaft 16 and the longitudinal axis of the head 12. The hosel 14 is connected to the body 20 via a bore hole 29 drilled to support the hosel 14 and the shaft 16 at the lie angle of 71°. The bore hole 29 can be drilled using any known industry technique. It is appreciated that any suitable lie angle $\gamma_1$ may be used.

It is acknowledged that the practice putter 10, as well as the playing putter 38 (more particularly described with reference to FIGS. 4–6), can be formed of material already well known in the golfing industry. For instance, the head 12, the hosel 14, and the wheels 22 and 23 can be formed of any suitable metallic, wood, or hard plastic material currently available. Similarly, the shaft 16 can be formed of any metallic material or an equivalent thereof and the handle 18 can include any suitable plastic or rubber grip.

FIG. 2 shows a side view of the practice putter 10. It is appreciated that an identical side view exists including wheel 22. However, only one side view of the practice putter 10 is provided in the FIGURES. Note that the body 20 (shown in phantom) is substantially cylindrical. The wheels 22 and 23 are also cylindrical and have a slightly larger circumference than the body 20. By having a slightly larger circumference than the body 20, the wheels 22 and 23 provide for the ground engaging points. Further, as shown in FIG. 1, the wheels 22 and 23 each have a width markedly smaller than the length of the body 20. However, it is appreciated by the inventor that both the circumference and width of the wheels 22 and 23 may vary without altering the scope of the invention as long as the wheels are large enough or so positioned on the body 20 to provide for the ground engaging points. Additionally, it is recognized that the body 20 could suitably be of any shape or dimension.

As shown in FIGS. 1 and 2, the wheels 22 and 23 comprise at least one knurl 24. The knurls 24 are suitably disposed and equally spaced apart on the outer surface of the wheels 22 and 23. It is appreciated that an configuration of knurls may be utilized. The knurls 24 function to engage and grip the putting surface. It is recognized that although the knurled wheels 22 and 23 are used in the preferred embodiment, suitable alternative gripping means could also be used without altering the scope of the invention. Additionally, the wheels 22 and 23 need not be provided with gripping means to fall within the scope of the invention.

As discussed above, the body 20 is substantially horizontally cylindrical. However, the body 20 is also provided with a relatively flat hitting surface 28. The relatively flat hitting surface 28 provides for a putting face for putting the ball in a conventional manner. The relatively flat hitting or ball engaging surface 28 is formed by known machining techniques in the preferred embodiment on the front portion 19 to make contact with a golf ball. Although machining the flat surface 28 is preferred, it is recognized by the inventor that other methods of formation can be used, i.e., casting. The relatively flat hitting surface 28 includes the so-called "sweet spot", located at the center of the flat surface 28. However, it is recognized that the "sweet spot" could be located at any position relative to the flat surface 28. Additionally, the relatively flat hitting surface 28 is preferably disposed at a loft angle $\alpha_1$ of 4°, as is shown in phantom in FIG. 2. The loft angle $\alpha_1$ is defined as the angle between the flat surface 28 and a corresponding line perpendicular to the putting surface. It is recognized by the inventor that any suitable loft angle $\alpha_1$ may be used. Notwithstanding the details of the relatively flat hitting surface 28, it is appreciated that the flat surface 28 could be suitably excluded from the preferred embodiment without altering the scope of the invention.

The preferred embodiment also includes grooves 27 formed in the body 20. The grooves 27, disposed both parallel and perpendicular to the surface 28, are present for the purposes of enhancing alignment or positioning of the practice putter 10 with a golf ball (not shown). Although not specifically limited as such, the grooves 27 are preferably filled with white paint or any other substance used to increase visibility of the grooves 27. It is recognized, however, that the grooves 27 could be suitably removed, and/or replaced with other means known in the art for enhancing positioning of the practice putter with respect to the ball.

Also, shown in FIG. 2 is a horizontal rotatable axle 26. The axle 26 will be more particularly described with reference to FIG. 3.

Figure 3:
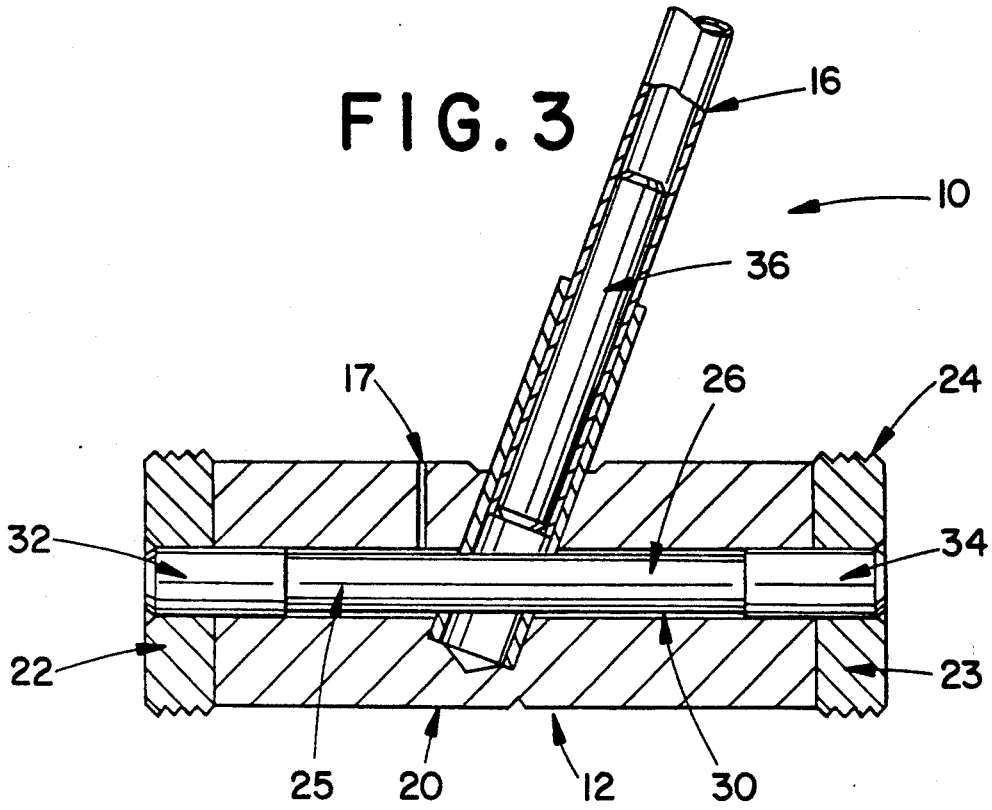
FIG. 3 is a partial cross sectional view of the practice putter of FIG. 1.

FIG. 3 shows a partial cross sectional view of the practice putter 10. The body 20 includes a cavity 30 extending horizontally therethrough. The cavity 30 is preferably cylindrical and concentrical with the body 20, the cavity 30 and the body 20 sharing the same longitudinal axis. The cavity 30 can be formed by known machining techniques. It is appreciated that the cavity 30 can be of any suitable shape and dimension.

The horizontally rotatable axle 26 is supported in the cavity 30 and includes a cylindrical middle portion 25, a cylindrical first end 32 and a cylindrical second end 34. The first and second ends 32 and 34 preferably have larger circumferences than the middle portion 25. The middle portion 25 is machined to have a smaller circumference in order to provide relief from binding upon rotation of the axle 26. The axle 26 is preferably formed of a metallic substance. However, it is recognized that any suitable material may be used.

The first wheel 22 is attached to the first end 32 and the second wheel 23 is attached to the second end 34. The wheels 22 and 23 rotate when the knurls 24 engage a putting surface and sufficient lateral force is exerted on the shaft 16. The wheels 22 and 23 will rotate in the same degree and at the same angular velocity as they are both fixedly attached (i.e., press-fitted, welded, etc.) to the axle 26. Identical rotation of the wheels 22 and 23 prevents improper angular rotation of the body 20 with respect to the line of the ball prior to engaging the ball. It is well known in the art that the relatively flat hitting surface 28 should be perpendicular to the line of the ball upon striking it to ensure that the ball travels in the desired direction. For instance, if only one wheel were utilized, the head of the putter might unduly rotate about the one wheel during the approach to the ball. This would cause the head to strike the ball at an angle other than one perpendicular to the line of the ball. Thus, identical rotation of the wheels 22 and 23 will substantially decrease, if not totally eliminate, the chance for the head 12 to improperly rotate during the approach to the ball.

Also illustrated in FIG. 3 is a weight 36 disposed in the shaft 16. The weight 36 acts to accentuate the "sweet spot", located in the relative center of the putter 10, because the axle 26 is disposed throughout the body 20, reducing the effectiveness of the "sweet spot". It is recognized, however, that the weight 36 is not essential to the invention. It can be suitably removed or alternative weight means can be employed to correspond to any location of a "sweet spot".

FIG. 3 also shows an oil hole 17 that is used to maintain lubrication of the axle 26. Lubrication of axle 26 is important for ease of rotation. It is, however, recognized that oil hole 17 is not essential to the invention.

Referring now to FIG. 4, the playing putter 38 comprises a playing head 40, a hosel 42 interconnecting the head 40 to the shaft 44, and a handle 46. The head 40 comprises a front portion 39, a back portion 41, end portions 50 and 52, grooves 58, grooves 59, a relatively flat hitting surface 48, and a bore hole 43. The relatively flat hitting surface 48 is formed on the front portion 39 and preferably contains the "sweet spot" of the head 40. Further, as with the practice putter 10, the lie angle $\gamma_2$ of the putter 38 is preferably 71°. Any suitable lie angle $\gamma_2$ may be used, however. The lie angle $\gamma_2$ is formed similar to the lie angle $\gamma_1$ of the practice putter 10 through use of the bore hole 43 and hosel 42.

FIG. 5 is a side view of the putter 38. Once again, it is appreciated that an identical side view exists including end portion 50. However, only one side view is provided. In particular, note that an end plug 56 of the end portion 52 is shown. It is understood that end portion 50 has a corresponding end plug 54 (not shown). The end plugs 54 and 56 will be more particularly described with reference to FIG. 6. Also note in FIG. 5 that the preferred loft angle $\alpha_2$ for the flat surface 48 is 4°. It is appreciated by the inventor that an alternative loft angle $\alpha_2$ could suitably be utilized.

Referring now to both FIGS. 4 and 5, the head 40 is substantially cylindrical, with the exception of the relatively flat hitting surface 48 formed by similar techniques as the flat surface 28 of the practice putter 10. The head 40 has a circumference substantially identical to the body 20 of the practice putter 10. The head 40 also has a length that is substantially similar to the practice head 12, including the body 20 and the wheels 22 and 23. Further, end portions 50 and 52 possess nearly identical dimensions, i.e., circumference and width, as the wheels 22 and 23 of the practice putter 10. The similarity between the end portions 50 and 52 and the wheels 22 and 23 aid in providing a playing putter 38 that is substantially identical to the practice putter 10. As a result, the overall circumference and length of the playing head 40 is substantially identical to the practice head 12.

Further, the end plugs 54 and 56 aid in creating the same "look and feel" for the practice putter 10 and the playing putter 38. Additionally, it is recognized that, although grooves 59 (preferably filled with white paint to improve visibility) are included in the preferred embodiment for alignment purposes, they are not essential to the invention. Similarly, the grooves 58, provided to render the "look" of the playing putter 38 substantially identical to the practice putter 10, are not essential to the invention.

FIG. 6 is a cross-sectional view of the putter 38. The head 40 includes a cavity 60 extending therethrough creating holes 62 and 64. The cavity 60 contributes to rendering the playing putter 38 substantially identical to the practice putter 10 in, for example, weight and the location of the "sweet spot". The cavity 60 is substantially cylindrical and concentrical with the head 40, the cavity 60 and the head 40 sharing the same longitudinal axis. It is appreciated by the inventor that cavity 60 may be of any suitable shape and dimension. Further, it is acknowledged that the cavity 60 may be excluded from the playing putter 38. As already discussed, the playing putter 38 and the practice putter 10 are preferably of identical dimension and weight. The inventor recognizes that cavity 60 is not necessary to that end if other suitable means are used to provide both putters 10 and 38 with the same "look and feel", i.e., substantially identical weights, dimensions, and "sweet spots".

The holes 62 and 64 are closed by disposing end plugs 54 and 56 respectively in the holes. The end plugs 54 and 56 are accordingly formed of any suitable material such as a metallic or hard plastic material. Further, the cavity 60 has contained therein weights 66 and 68. The weights 66 and 68 do not completely fill the cavity 60, leaving voids 70 and 72 in the cavity 60.

Also shown in FIG. 6 is a weight 74 disposed in the shaft 44. The weights 66, 68, and 74 are used to render the weight of the playing putter 38 substantially identical to the practice putter 10 and to an established standard of approximately 300 grams. It is recognized that a slight variation in the weights of the playing putter 38 and the practice putter 10 will not alter the scope of the invention.

In particular, the weights 66, 68, and 74 are used to compensate for the lack of wheels 22 and 23, axle 26, and weight 36 in the playing putter 38. It is appreciated by the inventor that weights 66 and 68 may be disposed in any other suitable manner in cavity 60. Further, the inventor recognizes that weights 66 and 68 are not essential to the invention. Accordingly, they could be excluded so long as other suitable means is employed to provide both putters 10 and 38 with a substantially identical weight.

Additionally, the weights 66, 68, and 74 also aid in establishing the "sweet spot" of the club. It is recognized that these weights are suitably disposed in the head 40 to render the "sweet spot" of the playing putter 38 substantially identical to the practice putter 10. That is, the "sweet spot" of each putter is located approximately in the center of the flat surfaces 28 and 48, respectively.

Further, although not particularly limited thereto, both the practice putter 10 and the playing putter 38 are balanced putters. This feature allows for an improved stroke and "sweet spots" located approximately in the center of the respective flat surfaces 28 and 48.

Substantially identical weight and dimensions of the putters 10 and 38 allow for more efficient realization of the training technique utilized with the putting kit and method of the present invention. This will become more apparent after review of the following discussion.

The practice putter 10 and the playing putter 38 can be used cooperatively to increase the putting skill level of a user. The practice putter 10 should be utilized to practice a putting stroke by engaging the wheels 22 and 23 to a putting surface and exerting sufficient lateral pressure on the shaft 16 to initiate the rolling of the wheels 22 and 23. The knurls 24 disposed on the wheels 22 and 23 will aid in the initiation and maintenance of a proper putting stroke particularly with respect to the alignment of the practice putter with the ball prior to and after contact with the ball.

In this regard, the wheels 22 and 23 will roll in an identical degree and angular velocity since they are fixedly attached to the same horizontally rotatable axle 26. As such, by keeping the wheels 22 and 23 engaged to the putting surface, the chance for undue rotation of the practice putter 10 is greatly reduced.

The user should also maintain engagement of the wheels to the putting surface to become familiar with the skill of keeping the putter head 12 low to the ground through the whole putting stroke. Along this line, the circumference, and corresponding diameters, of the wheels 22 and 23 and/or the placement of the wheels with respect to the body 20 can be adjusted, thereby allowing for different vertical positioning of the putting head 12 with respect to the putting surface. In the preferred embodiment of the invention, the wheels 22 and 23 are only slightly larger in diameter than the diameter of the body 20, i.e., about 1.4 inches as opposed to 1.3 inches for the body 20. In addition, in the preferred embodiment, the wheels 22 and 23 are centrally vertically placed with respect to the body 20.

Once the user is comfortable with a putting stroke that is straight and low to the ground, a ball can be utilized not only to practice the stroke but also to practice striking the ball and following through with the stroke after striking the ball. This, again, is accomplished by maintaining the engagement of the wheels 22 and 23 to the putting surface throughout the whole stroke, even after striking the ball.

It is recommended by the inventor that a user practice his/her putting stroke repetitively with the practice putter 10. The number of repetitions should be sufficient for a user to obtain the feel of a fundamentally sound stroke by keeping the head of the club straight and low to the ground and following through after striking the ball. It will also aid the user in preventing angular rotation of the putter head 12 relative to the line of the ball thereby stabilizing and "squaring" the head of the club. By repetitively using the practice putter 10, the user will develop the muscle motion and positive state of mind necessary for a sound putting stroke.

Once the user is comfortable with his/her putting stroke utilizing the practice putter 10, the playing putter 38 can be utilized to capitalize on the proper stroke, developed by the practice putter 10, in regulation play. Since the practice putter 10 has movable parts, it can not be used in tournament play.

As a result, the playing putter 38 is manufactured to have substantially identical dimensions and a similar look as the practice putter 10. For instance, the end portions 50 and 52 correspond to the wheels 22 and 23 of the practice putter 10. Similarly, the weight of the playing putter 38 is rendered substantially identical to the weight of the practice putter 10. As discussed above, it is recognized that the weights of the practice putter 10 and the playing putter 3B may vary slightly. However, a slight variation will not effect the overall similar "look and feel" of the putters. By rendering the dimensions and weight of the playing putter 38 substantially identical to the practice putter 10, a user can most effectively utilize skills developed with the practice putter 10 when playing in regulation play utilizing the playing putter 38.

The above description merely provides a disclosure of a particular embodiment of the invention and is not intended for the purpose of limiting the same thereto. As such, the invention is not limited to only the above described embodiment. Rather, it is recognized that one skilled in the art could conceive alternative embodiments that fall within the scope of the invention.

Having thus described the invention, I claim:

- 1. A golf putting practice kit comprising:
  1) a first putter comprising:
     a first hosel means for receiving a shaft and connecting the shaft to a first cylindrical body,
     a first cylindrical body having a relatively flat hitting surface and interconnected to the hose means, the first body further having a diameter and a first length, a first cavity formed in the first body and extending horizontally therethrough wherein said cavity is positioned substantially parallel to the hitting surface, a horizontally rotatable axle having a middle portion and first and second ends, said middle portion being supported within the first cavity and the first and second ends extending horizontally beyond the first cavity, a first wheel for engaging a playing surface, the first wheel having a first width and being fixedly attached to the first end, and, a second wheel for engaging the playing surface, the second wheel having a second width and being fixedly attached to the second end; and, 2) a second putter comprising:

a second hosel means for receiving a second shaft and connecting the second shaft to a second cylindrical body, a second cylindrical body interconnected to the second hosel means, the second body having a diameter equal to said first mentioned diameter and a second length, the second length comprising the first length, the first width and the second width, a second cavity formed in the second body and extending therethrough, and, weight means disposed in the second cavity for adding weight to the second putter so that the second putter weighs substantially the same as the first putter.

2. The golf putting practice kit of claim 1, wherein the first and second wheels comprise gripping means for gripping the playing surface.

3. The golf putting practice kit of claim 2, wherein the gripping means comprises knurls.

4. A golf putting practice kit comprising:

1) a first putter including a first head, the first head having a first weight and comprising:

a first body, a horizontally rotatable axle, having a first end and a second end, associated with the first body, a first wheel attached to the first end, and, a second wheel attached to the second end; and, 2) a second putter devoid of wheels including a second head, the second head having a second weight and comprising:

a second body, and, weight means associated with the second body for rendering the second weight substantially identical to the first weight.

5. The golf putting practice kit of claim 4, wherein the first and second wheels comprise gripping means.

6. The golf putting practice kit of claim 5, wherein the gripping means comprises knurls.

* * * * *